US006286392B1

(12) United States Patent
Smith

(10) Patent No.: US 6,286,392 B1
(45) **Date of Patent: *Sep. 11, 2001**

(54) HITCH COVER WITH BOTTLE OPENER

(75) Inventor: Kenneth Wayne Smith, Elkhorn, WI (US)

(73) Assignee: Bergamot Incorporated, Delavan, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/645,680

(22) Filed: Aug. 24, 2000

(51) Int. Cl.[7] ..... B25B 27/00
(52) U.S. Cl. ..... 81/3.15; 81/3.09; 7/100
(58) Field of Search ..... 81/3.15, 3.09; 7/100, 151, 170

(56) References Cited

U.S. PATENT DOCUMENTS

| | | | | |
|---|---|---|---|---|
| D. 278,517 | * | 4/1985 | Milin | D9/437 |
| D. 326,834 | * | 6/1992 | Kuhlemeier | D12/162 |
| D. 399,805 | * | 10/1998 | Donalies | D12/162 |
| D. 408,236 | * | 4/1999 | Rennick | D8/38 |
| D. 413,291 | * | 8/1999 | Corns, Jr. | D12/162 |
| D. 415,080 | * | 10/1999 | Schultz | D12/162 |
| D. 426,798 | * | 6/2000 | Peroni | D12/162 |
| D. 433,297 | * | 11/2000 | Haas | D8/34 |
| 3,782,761 | * | 1/1974 | Cardin, Sr. | 280/507 |
| 5,603,178 | * | 2/1997 | Morrison | 40/591 |
| 6,007,033 | * | 12/1999 | Casson et al. | 248/224.7 |
| 6,019,386 | * | 2/2000 | Morelockq | 280/507 |
| 6,086,438 | * | 7/2000 | Wang | 440/49 |

OTHER PUBLICATIONS

Hitch Buckle Internet Printout dated May 11, 1999 (2 pp.).
Hitch Ware Internet Printout dated 0/2/99 (1 p.).
Herrington The Enthusiasts' Catalog, Fall 1999, p. 51 (2 pp. including cover page).

* cited by examiner

*Primary Examiner*—James G. Smith
*Assistant Examiner*—Hadi Shakeri
(74) *Attorney, Agent, or Firm*—Foley & Lardner

(57) ABSTRACT

A hitch cover for the hitch tube of a vehicle includes a bottle opener. One illustrated hitch tube cover includes a wire form attached thereto for being inserted into the hitch tube and securing a face plate across the open end of the hitch tube. A lock or pin extends through the conventional hitch tube openings, passing through the wire form to prevent removal of the hitch cover. Also illustrated are face plates which have the bottle opener as an integral part thereof or an insert formed as a part of the face plate.

10 Claims, 4 Drawing Sheets

HITCH COVER WITH BOTTLE OPENER

CROSS-REFERENCE TO RELATED APPLICATIONS, IF ANY

NONE

BACKGROUND OF THE INVENTION

1. Field of the Invention

The present invention relates generally to the art of covers for hitch tubes which receive hitches used to tow trailers, boats and the like behind cars, trucks, sports utility vehicles (SUV), etc. More specifically, the present invention relates to a hitch cover which includes a bottle opener on its external surface or as part of the hitch cover itself. Still more specifically, the hitch cover of the preferred embodiment is of the type which may be easily inserted and locked into a hitch tube and which may be manufactured inexpensively using a wire form to hold a face plate over the rear opening of the hitch tube. In this embodiment, a wire form is pivotally attached to the rear surface of a face plate (or a component thereof), the wire form being deformed as it is inserted into the tube so that the spring forces of the wire form will assist in holding the hitch cover in place and prevent rattling of the hitch cover during use of the vehicle.

2. Description of the Prior Art

Hitches attached to cars, trucks, sports utility vehicles and the like are commonplace. They typically include a hitch tube permanently mounted to the vehicle and a hitch which is inserted into the tube and locked thereto, usually with a pin or a lock extending through openings on opposed walls of the tube. A ball is usually mounted at or near the outer end of the bar and is used to mount the trailer or other device to be towed by the vehicle. Several standard sized hitch tubes are encountered in most car, light truck and SUV applications, designated as Class II and Class III. The former has an inner tube opening which is a one and one-quarter inch (1¼") square, and the latter has an inner tube opening which is also square but with two inch (2") sides.

The hitch tubes include a rearwardly oriented opening which receives the hitch bar. In some hitches, the opening is a central extension of a square piece of tubing, while in other models, the opening is surrounded by a flange, a plate or some other component of the vehicle or the hitch tube mounting structure. The opening, while functionally necessary, is not attractive when the hitch is removed, and it detracts from the overall aesthetics of the rear of the vehicle. As a result, it has been suggested that covers be provided for the hitch tube opening.

Several styles of cover are currently available, ranging from simple plastic or rubber devices that are frictionally inserted at the very end of the hitch tube to very expensive decorative covers. One known decorative cover includes a face plate having a planar rear surface and a flat plate extending from a central location on the rear of the plate. The plate is inserted into the hitch tube until a hole in the plate is aligned with openings in the opposed sidewalls of the hitch tubes. When such alignment occurs, a pin or lock is inserted through the assembly to retain the hitch cover in place. This known hitch cover is cast as a single, integral piece, and accordingly it is expensive. It furthermore suffers from a problem of rattling, unless the hole and pin or lock alignment is nearly perfect.

Another known hitch cover includes a multi-component assembly which is attached to the rear of a face plate. This device is illustrated in the Internet print-out submitted with this application for patent and is entitled HITCH BUCKLE Product Line (dated May 11, 1999). This complex product is also expensive and requires assembly before installation.

HITCHWARE™ solid cast aluminum billet hitch covers are illustrated in the accompanying Internet print-out dated Sep. 2, 1999. It is believed that the mounting component of this product is a cast, solid square box inserted into the hitch tube, with a hole therethrough for alignment with the holes of the hitch tube. This device, due to its construction, is also costly to produce and expensive to buy, thus reducing its attractiveness to impulse-buying customers.

Other hitch covers including tube stock mountings are shown at page 51 of Herrington's, the Enthusiasts' Catalog, Fall 1999, a copy of which is supplied with this application for patent. These polished, billet aluminum devices are expensive and beyond the price level of impulse buyers who desire an attractive hitch cover.

The assignee of this application has developed a less expensive hitch cover which may be manufactured simply and economically and which may be packaged, displayed and stored in less space than other products currently available. The application for a patent is entitled HITCH COVER and was filed on Dec. 14, 1999 by K. Wayne Smith, et al. and assigned Ser. No. 09/460,967. It includes a face plate which may be of a variety of shapes and a spring wire form coupled to the rear of the face plate and having at least one dimension exceeding the diagonal dimension of the hitch tube. The wire form is constructed and arranged to be inserted into the hitch tube by compressing the wire form. The hitch cover is accordingly held within the hitch tube by the resulting outwardly directed spring forces. The face plate may contain any type of decorative art work including logos, graphic or pictorial scenes, sports items, and the like. After insertion of the wire form into the hitch tube, in the preferred embodiment of the above-referred application, a hitch pin or lock is inserted through the conventional hitch tube openings to prevent removal of the wire form, and hence the hitch cover, from the hitch tube. The hitch cover of the earlier application has met with commercial success and is favored by retailers who can display many more of the hitch covers in a designated display space than is possible with hitch covers such as those described earlier in this application.

One popular use for vans, trucks and SUVs is tailgating, an increasingly popular activity usually associated with a sporting event. It is becoming increasing fashionable to carry a variety of picnicking paraphernalia in the vehicle, such as grills, picnic tables, chairs and the like. A meal is prepared at home or at the activity site and consumed prior to the event. Beverages are typically carried in coolers and are opened during the tailgating experience. To the knowledge of the present inventors, no one has incorporated a bottle opener in an SUV, van or truck, much less at a location which would be convenient for those participating in a tailgating party.

As seen above, a variety of hitch cover products are currently available, but none of them are sturdy, decorative and inexpensive to manufacture, such that more consumers will be able to afford them. Moreover, it is not suggested in any of this prior art to provide a bottle opener as part of the hitch cover. The development of a rugged, inexpensive, rattle-free, reliable and decorative hitch cover which also includes the functional ability of opening a bottle would represent a significant advance in this art.

FEATURES AND SUMMARY OF THE INVENTION

A principal feature of the present invention is to provide a hitch tube cover which also includes a bottle opener.

A different feature of the present invention is to provide a combined hitch cover and bottle opener which is rugged, inexpensive, preferably rattle-free, reliable and decorative and which overcomes the disadvantages of the prior art hitch covers discussed above.

Another feature of a preferred embodiment of the present invention is to provide a wire form mounting for the face plate of a hitch cover which includes a bottle opener.

A different feature of the present invention is to provide a readily deformable wire form mounting for the face plate of a hitch cover and bottle opener which holds the hitch cover within a hitch tube in a secure, rattle-free manner.

A still further feature of the present invention is to provide a mounting system for hitch covers which may be readily adapted for different sizes of hitch tubes and different shapes of face plates, each face plate including a bottle opener as a component thereof or having a bottle opener formed integrally.

Another feature of the present invention is to provide a hitch cover and bottle opener combination which is easy to package, display and ship in a nearly flat arrangement.

A further feature of the present invention is to provide a hitch cover which is sufficiently inexpensive to the end user when combined with a bottle opener to permit the end user to purchase several different hitch covers having different decorative displays, e.g. seasonal displays or displays involving different sports, hobbies, etc.

How these and further features of the present invention are accomplished will be described in the following detailed description of a preferred and an alternate embodiment, taken in conjunction with the FIGURES. Generally, however, the features are accomplished by providing a face plate for a hitch cover which may have a variety of shapes, but preferably includes a generally planar rear surface. A bottle opener is attached to the front surface, or the face plate is molded, cast or otherwise formed to include a bottle opener integrally formed in the face plate itself. Alternately, an insert is formed with the face plate and serves as the bottle opener.

In the most preferred embodiment, a wire form is coupled to the face plate, the wire form being made from spring steel and being deformed when it is inserted into the hitch tube, so that the hitch cover will be held firmly in the hitch tube due to the outwardly directed spring forces of the wire form acting on the inner diagonal corners of the hitch tube. The wire form is rotatably coupled to the back of the face plate and is generally U-shaped and adapted to slide along diagonal corners of the hitch tube when it is inserted. The face plate may include a raised rim on the rear surface arranged to slidingly fit within the end of the hitch tube and a sealing/cushioning member (such as an 0-ring or gasket) may be provided to prevent rattling of the plate against the hitch tube. In the preferred and illustrated embodiment, the wire form is designed so that a conventional pin or lock will be captured within the wire form to prevent removal thereof unless the pin or lock is withdrawn.

In other embodiments of the invention, different attachment techniques may be employed for securing the face plate/bottle opener combination to the hitch tube, such as the use of tubular stock, plates or the like.

Other ways in which the features of the present invention are accomplished will become apparent to those skilled in the art after the present specification has been reviewed. Such other ways are deemed to fall within the scope of the present invention if they fall within the scope of the claims which follow.

BRIEF DESCRIPTION OF THE DRAWINGS

In the various FIGURES, like reference numerals are used to indicate like components.

DETAILED DESCRIPTION OF THE PREFERRED AND ALTERNATE EMBODIMENTS

Figure 1:
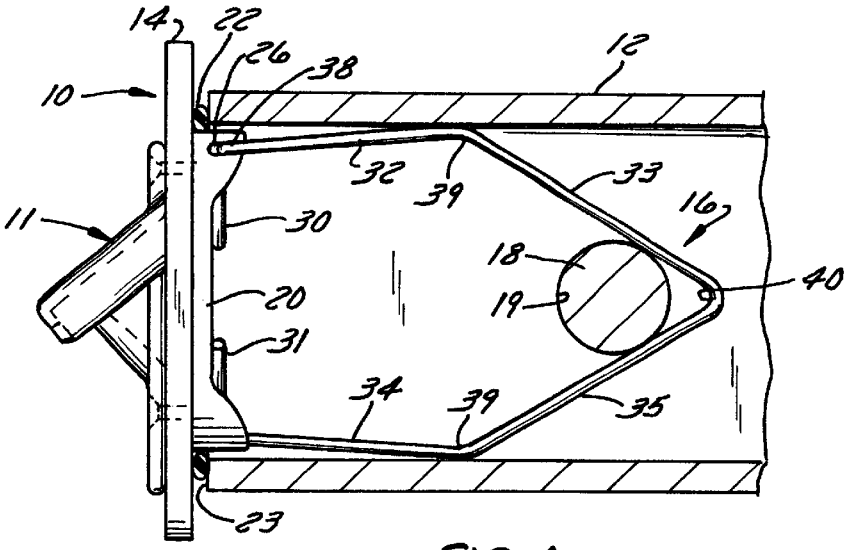
FIG. 1 is a side view of the preferred embodiment of the hitch cover of the present invention, with a hitch tube shown in phantom lines for purposes of illustrating important features of the wire form contained therein and a bottle opener attached using threaded fasteners passing through the face plate.

Before proceeding to a detailed description of the preferred and alternate embodiments of the present invention, several general comments can be made about the applicability and the scope of the present invention.

First, the shape of the face plate may be selected from any of a variety of shapes, such as circles, ovals, squares, rectangles, other polygon shapes, triangles, triangles with gently rounded sides (see FIG. 1A), and may have irregular shapes, such as, but not by way of limitation, animal or fish shapes, the shapes of buildings, sports equipment, states, vehicles, etc.

Second, while the face plate is preferably decorative, it can be plain and, for example, merely have a border. Decorations may be added in the manufacturing process or at a later stage and include without limitation, names, logos, graphics or pictorial representations of sporting goods, animals, fish, vehicles, slogans, etc. The decoration may be added to the face plates by any known process such as painting or printing, and where the decorative face plate is prepared in relief from metals, such as pewter, they can be made by casting or stamping processes.

Third, the size of the face plate can also vary widely, the size preferably being large enough to fully cover the opening or mouth of the hitch tube.

Fourth, the material used for the face plate can be selected from the group of materials including metals, alloys and plastics. The wire form component, on the other hand, is preferably made from spring wire, such as stainless steel spring wire, having sufficient strength to hold the hitch cover in place, be deformable without the use of excessive force to permit attachment of the hitch cover to the hitch tube, and desirably be made from a non-corrosive material, since a corrosive environment is found in and around the hitch of a vehicle, especially in locals where salt may be used for winter snow conditions and the like.

Fifth, the illustrated configuration for the wire form is preferred, but other forms may be employed, including forms made from more than a single strand of wire. The primary requirements for the wire form are that it be capable of attachment to the face plate, that it deform under a resilient or a spring force so that it can be inserted into a hitch tube, and that it have elastic or spring memory so that the components operate against the interior of the hitch tube to resist removal thereof and prevent rattling of the wire form with respect to the hitch tube. Preferably, the wire form should be capable of being captured by the hitch pin, in which case the spring force requirement is not essential.

Sixth, a common O-ring or gasket is illustrated in the FIGURES which acts as a cushioning/sealing material between the hitch tube and the face plate. Other sealing devices can be used in a variety of forms and should preferably be resilient, elastic, weatherproof and inexpensive to manufacture.

Seventh, the way in which the wire form is attached to the face plate can also be accomplished in a variety of different ways, three of which are illustrated in the aforementioned Smith, et al. patent application. As additional examples, the ends of the wire form could be captured in channels provided in the face plate and a cover could be applied thereover, or the wire form could also be welded or otherwise securely and rigidly attach to the rear of the face plate without departing from the inventions intended scope.

Eighth, while a wire form is shown in the illustrations as being the technique for attaching the face plate to the hitch tube, other techniques known in the art can be employed, such as the use of elongate, square tubes adapted to be slidingly received within the hitch tube and having holes therein to mate with the pin or lock holes of the hitch tube. Other techniques, such as providing a simple, friction-fit extension on the back of the face plate could also be employed, as covered elongate metal plates.

Ninth, three different types of bottle openers are illustrated, but the invention should be interpreted broadly to include all shapes of bottle openers which can be attached to or formed as part of the face plate of the present invention. When they are attached to the face plate, the attachment may be by threaded fasteners such as bolts or screws, other types of fasteners, such as adhesives, welding or the like could be employed.

Finally, it should be indicated that in the illustrated embodiments, the rear of the wire form itself, i.e., the end furthest from the face plate, is designed to extend just past the location of the hitch tube where opposed side holes exist. In this way, a standard pin or lock will be captured by the wire form when the pin or lock is fully inserted, adding security to the overall device and further preventing rattling of the wire form within the hitch tube. However, the invention also contemplates the use of wire forms or other attachments which extend beyond the pin or lock location, so that only the security benefit is provided by the pin or lock and the anti-rattle result is achieved through appropriate design of the attachment device itself.

Figure 3:
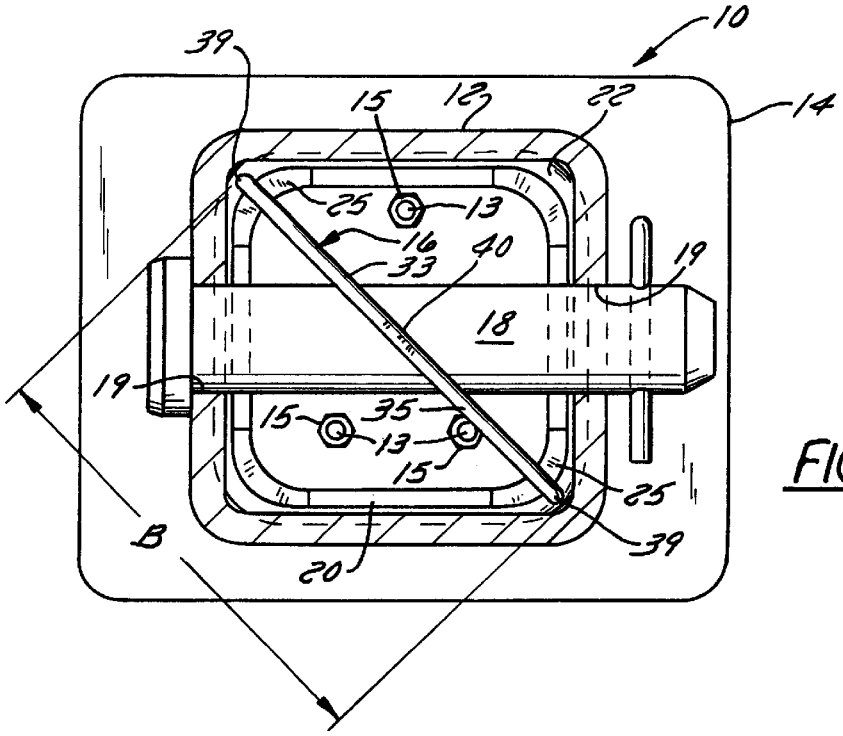
FIG. 3 is a sectional view taken along the line 3—3 of FIG. 1.

Proceeding now to the description of the preferred and two alternate embodiments of the invention, FIG. 1 shows a hitch cover 10 according to the preferred embodiment coupled to a hitch tube 12. Hitch cover 10 includes a face plate 14 and a wire form 16 attached thereto as will become more apparent hereafter. FIGS. 1 and 3 also show a hitch pin or a lock 18 extending through a pair of aligned apertures 19 in hitch tube 12, the pin or lock 18 extending through the wire form 16 at a location remote from the face plate 14. It will be apparent from this introduction that the pin or lock 18 will prevent removal of the hitch cover 10 unless the pin or lock 18 is first removed. Pins and locks used to secure hitch bars to hitch tubes are well known, and further details do not need to be provided, as they do not, in and of themselves, form part of the present invention.

Figure 1A:
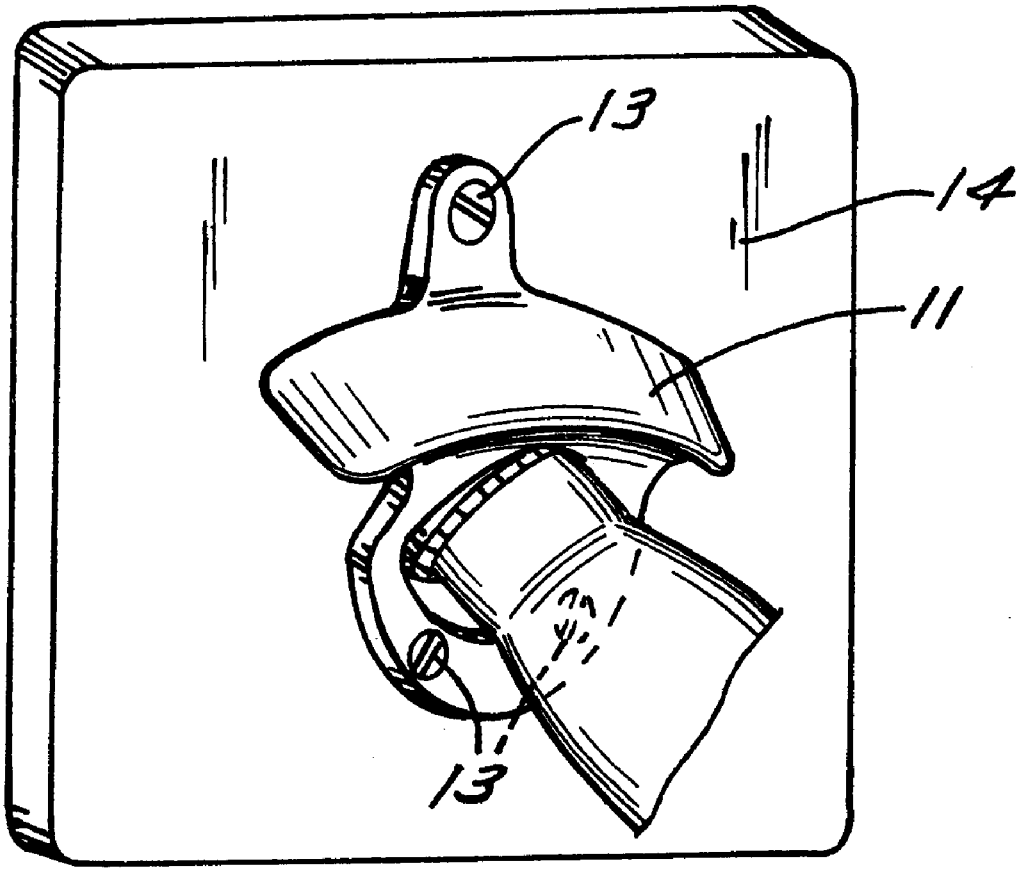
FIG. 1A is a front perspective view illustrating a face plate with a bottle opener secured thereto and showing a portion of a bottle.

FIG. 1 also shows in side view a bottle opener 11 attached to the front surface of face plate 10. As is evident from the exploded view shown in FIG. 2, bottle opener 11 is secured to face plate 14 using three bolts 13 which extend through face plate 14, with bolts 13 engaging the nuts 15 on the opposite side of face plate 14. As mentioned previously, other attachment techniques can be used. The bottle opener itself is shown in a front perspective view (FIG. 1A). This opener, in and of itself is well known and was the subject of a patent issued more than 50 years ago. As will become apparent as the description continues, a variety of bottle openers can be used in conjunction with the hitch cover 10, and FIGS. 1 and 2 are used to illustrate a class of the invention in which the bottle opener is attached to an otherwise planar surface of face plate 14 or 14A.

Figure 2:
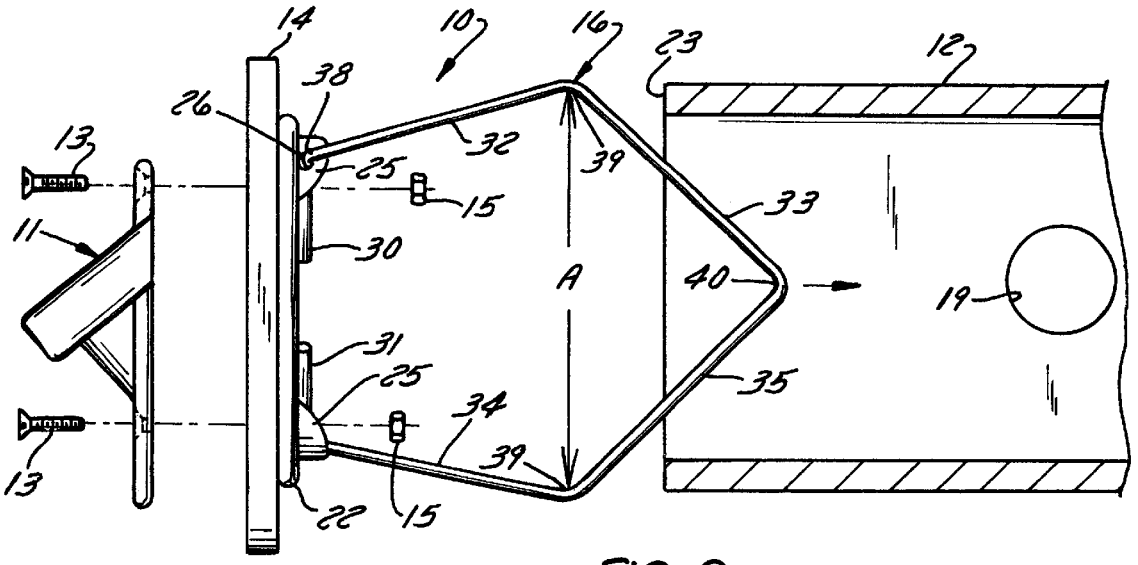
FIG. 2 is an exploded side view of the bottle opener, hitch cover and hitch tube shown in FIG. 1.
Figure 4:
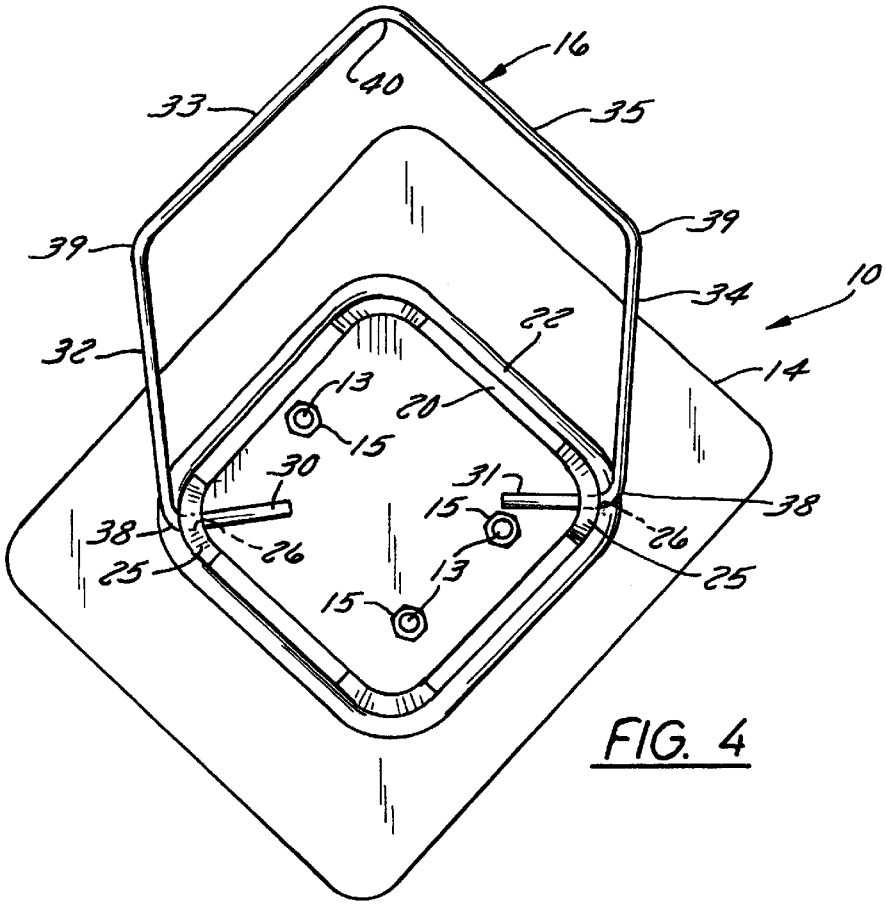
FIG. 4 is a rear elevational view of the face plate of the hitch cover shown in FIG. 1, with the wire formed folded to its storage and/or shipment position.

FIG. 2 is a side, exploded view of certain of the components shown in FIG. 1 and together with FIG. 4 clearly show the wire form 16 and how it is attached to face plate 14. Face plate 14 in the preferred embodiment includes a generally square rim 20 constructed and arranged to fit within hitch tube 12. In its most preferred form, the fit of rim 20 within tube 12 is snug.

In addition to the snug fit, a cushioning/sealing member 22, for example, a neoprene O-ring, is stretched or placed around the rim 20. It will be appreciated then that when the wire form 16 is inserted into hitch tube 12, the cushioning/sealing member 22 will lie against the end face 23 of the hitch tube 12 and will both prevent rattling of the face plate 14 and seal the ends 23 of the hitch tube from environmental contaminants.

The coupling of wire form 16 can best be appreciated by referenced FIGS. 2 and 4 which show wire form 16 rotatably coupled to a pair of ears 25 on opposed corner of rim 20. Portions 30 and 31 of the wire form 16 extend through holes 26 in the ears 25.

Wire form 16 is preferably constructed from a single strand of spring wire, such as 313 stainless steel wire, 0.0915 gauge, available from Industrial Steel and Wire Company, 19101 North Narrogausett Avenue, Chicago, Ill., U.S.A. Portions 30 and 31 are formed by bending the ends of the wire strand at about a 90 degree angle indicated by reference numeral 38. Extending from portions 30 and 31 are portions 32 and 33 which diverge outwardly with respect to the bends 38, for a distance of approximately 1 to 2 inches 9 (depending on the size of the interior of hitch tube 12, i.e., the class of the hitch tube), where the wire is further bent at an obtuse angle 39. The last of the wire form portions 34 and 35 converge to an acute angle bend 40 at the approximate midpoint of the wire strand.

Referring especially to FIG. 2, it will be noted that the distance "A" between the obtuse angle bends 39 exceeds slightly the diagonal distance "B" (see FIG. 3) between opposed corners of the inside of the hitch tube 12. To insert the hitch cover 10 into the hitch tube 12, it will be necessary to exert a force on face plate 14 causing the obtuse angle bends 39 to approach one another slightly. Once they enter the hitch tube 12, they will slide along opposed corners under spring resistance due to the outwardly directed spring forces of wire form 16.

As is now apparent from the description to this point, the angle bend should be located far enough from the rear surface of face plate 14 that the pin or lock 18 can be inserted within the wire form 16, most preferably very near the angle bend 40. While anti-rattle of the wire form 16 is provided by the spring forces, it is also provided by the preferred location of the angle bend 40 with respect to the pair of tube openings 19.

Figure 5:
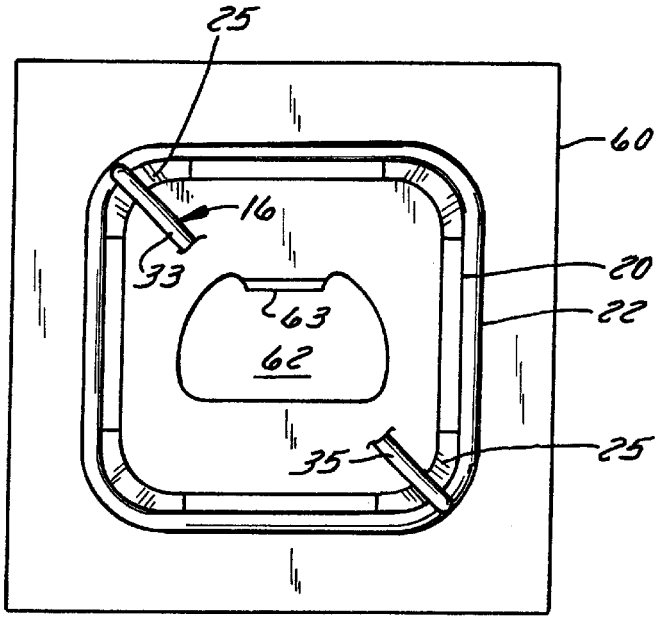
FIG. 5 is a rear elevation of an alternate embodiment of the present invention in which the face plate casting includes an opening and a tongue which act as a bottle opener.

FIG. 5 illustrates an alternate embodiment of the present invention in which a face plate 60 having a rim 20 on the rear thereof is manufactured to include a central opening 62 and a tongue 63. The material used to make face plate 60 in this embodiment will preferably be a metal or alloy, and the opening 62 and arrangement of tongue 63 are such that a bottle may be opened when a portion of the cap is inserted into opening 62. This shape of bottle opener is well known to those familiar with the bottle opening art.

Figure 6:
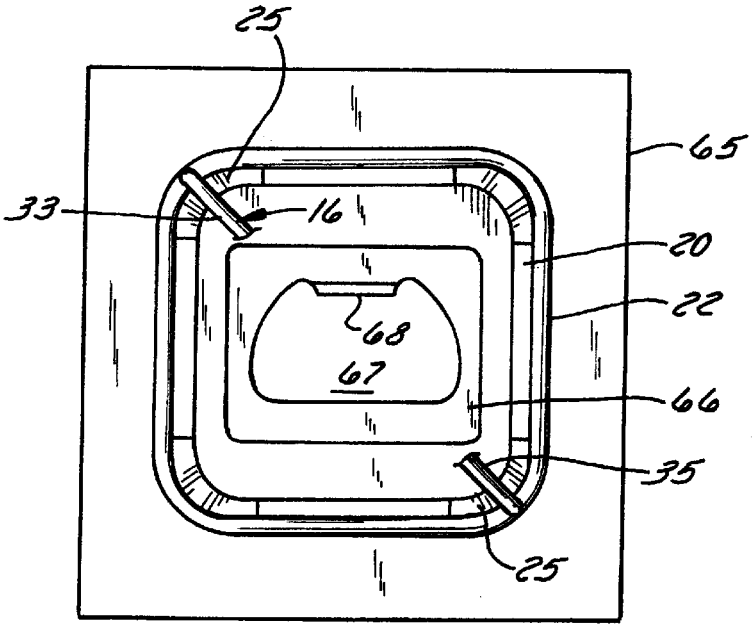
FIG. 6 is a rear elevation view of another embodiment of the invention and illustrating a third type of bottle opener configuration, i.e. one similar to that shown in FIG. 5, but with a steel insert defining the opening and the tongue.

A different embodiment of a face plate 65 is shown in FIG. 6 which also is a rear view and shows a rim 20. FIG. 6 differs from FIG. 5 in that an insert 66 is included in the area bordered by rim 20 and defines an opening 67 and a tongue 68 which are similar in size and arrangement to the opening and tongue shown in FIG. 5. The insert 66 in this embodiment is made from a material which is stronger than the material used for constructing the remainder of face plate 65. As an example, if the face plate is made from a soft metal such as pewter, the insert can be made from stainless steel. Other combinations will readily appear to those familiar with the materials science.

Now that a single embodiment of the invention has been illustrated in a number of views and two alternate embodiments have been illustrated to show the breadth of the invention, it bears repeating that the invention is not to be limited to any particular size, shape or structural arrangement as indicated at the beginning of this section of the specification. Rather, the invention should be construed only by the scope of the claims which follow and which should be interpreted in accordance with the teachings provided hereinabove.

What is claimed is:

1. A hitch cover and a hitch tube comprising:

a hitch tube having an open end;

a face plate having an inner surface and an outer surface;

a resiliently deformable spring wire form coupled to the inner surface of the face plate for attaching the face plate to the hitch tube, the wire form having at least one dimension exceeding the largest interior dimension of the hitch tube; and means for opening a bottle on the outer surface of the face plate.

2. The hitch cover and tube of claim 1, wherein the face plate includes a square rim on the inner surface adapted to be inserted into the open end of the hitch tube.

3. The hitch cover and tube of claim 2, wherein the rim is square and includes a pair of ears on opposed corners.

4. The hitch cover and tube of claim 2, wherein a cushioning/sealing member surrounds the rim.

5. The hitch cover and tube of claim 1, wherein the bottle opener is coupled to the outer surface of the face plate by at least one threaded fastener.

6. The hitch cover and tube of claim 1, wherein the bottle opener is an integral part of the face plate.

7. The hitch cover and tube of claim 1, wherein the face plate includes an insert, and wherein the face plate is made from a first material and the insert is made from a second, harder material.

8. The hitch cover and tube of claim 6, wherein the face plate is a metal casting and the bottle opener is defined by an opening in the face plate and a tongue extending into the opening.

9. A hitch cover and a hitch tube, the hitch cover comprising:

a face plate including a bottle opener; and a resiliently deformable wire form coupled to the face plate attaching the face plate to the tube.

10. The hitch cover and hitch tube of claim 9, wherein the hitch tube has a pair of aligned hitch pin openings, the wire form being constructed so that a hitch extending through the hitch pin openings will pass through the wire form and prevent removal of the hitch cover from the hitch tube, and a hitch pin extending through the openings.

* * * * *